US010353345B2

(12) United States Patent
Poole et al.

(10) Patent No.: US 10,353,345 B2
(45) Date of Patent: Jul. 16, 2019

(54) ELECTRONIC CIRCUIT FOR CONTROLLING THE OPERATION OF A WATCH

(71) Applicant: Microdul AG, Zurich (CH)

(72) Inventors: Philip John Poole, Muhlehorn (CH); Markus Erwin Annen, Baden (CH); Dan Liu, Safnern (CH)

(73) Assignee: MICRODUL AG, Zurich (CH)

( * ) Notice: Subject to any disclaimer, the term of this patent is extended or adjusted under 35 U.S.C. 154(b) by 76 days.

(21) Appl. No.: 15/550,535

(22) PCT Filed: Feb. 15, 2016

(86) PCT No.: PCT/EP2016/053159
§ 371 (c)(1),
(2) Date: Aug. 11, 2017

(87) PCT Pub. No.: WO2016/128578
PCT Pub. Date: Aug. 18, 2016

(65) Prior Publication Data

US 2018/0032035 A1 Feb. 1, 2018

(30) Foreign Application Priority Data

Feb. 13, 2015 (EP) ..... 15155119

(51) Int. Cl.
*G04C 10/00* (2006.01)
*G04G 19/12* (2006.01)

(52) U.S. Cl.
CPC ..... *G04C 10/00* (2013.01); *G04G 19/12* (2013.01)

(58) Field of Classification Search
CPC ..... G04C 10/00; G04G 19/12; G04G 21/00; G04G 19/00
(Continued)

(56) References Cited

U.S. PATENT DOCUMENTS 5,045,988 A 9/1991 Gritter et al.
5,289,452 A 2/1994 Sakamoto et al.
(Continued)

FOREIGN PATENT DOCUMENTS

EP 2541347 A2 1/2013

OTHER PUBLICATIONS

Ruffieux et al., "A Compact, Versatile, Miniature Timing Microsystem Using Two co-Integrated Wafer-Level Packaged Silicon Resonators", IEEE, 2014, vol. 978, pp. 435-438.

*Primary Examiner* — Edwin A. Leon
(74) *Attorney, Agent, or Firm* — The Webb Law Firm

(57) ABSTRACT

An electronic watch circuit for controlling the operation of a watch having analogue hands has an integrated circuit which contains data values to be transmitted to registers and transmitted to peripheral members of the watch. The electronic watch circuit further has a quartz crystal providing the clock base frequency to the integrated circuit and a connecting device arranged for enabling the peripheral member controllers, the quartz crystal, and the processor to communicate data relating to the operation of the watch to each other. The electronic circuit further has a microcontroller including a processor connected to a programmable memory. The integrated circuit has an interface, the microcontroller has a further interface, and the microcontroller is connected with integrated circuit by the interfaces allowing bidirectional exchange of data between the microcontroller and the integrated circuit.

14 Claims, 2 Drawing Sheets

(58) Field of Classification Search
USPC ..... 368/204, 10, 64, 66, 80, 155–156, 203; 713/320, 323–324
See application file for complete search history.

(56) References Cited

U.S. PATENT DOCUMENTS

| | | | | |
|---|---|---|---|---|
| 6,047,380 | A | 4/2000 | Nolan et al. | |
| 6,061,304 | A * | 5/2000 | Nagata | G04C 10/00 368/204 |
| 6,144,621 | A * | 11/2000 | Sase | G04G 19/08 368/204 |
| 6,580,665 | B1 * | 6/2003 | Kamiyama | G04C 10/04 368/204 |
| 8,130,596 | B2 | 3/2012 | Godat | |
| 8,274,863 | B2 * | 9/2012 | Ihashi | G04G 19/08 320/135 |
| 2006/0005054 | A1 | 1/2006 | Fernald et al. | |
| 2013/0080819 | A1 | 3/2013 | Bowling et al. | |
| 2013/0303087 | A1 | 11/2013 | Hauser et al. | |
| 2014/0215246 | A1 | 7/2014 | Lee et al. | |

* cited by examiner

ELECTRONIC CIRCUIT FOR CONTROLLING THE OPERATION OF A WATCH

CROSS-REFERENCE TO RELATED APPLICATIONS

This application is the United States national phase of International Application No. PCT/EP2016/053159 filed Feb. 15, 2016, and claims priority to European Patent Application No. 15155119.9 filed Feb. 13, 2015, the disclosures of which are hereby incorporated in their entirety by reference.

BACKGROUND OF THE INVENTION

Field of the Invention

The present invention relates to an electronic circuit for controlling the operation of a watch having analogue hands, or other means of time display such as LED's, LCD or electronic ink, as well as an integrated circuit for use in such an electronic circuit.

Description of Related Art

US 2009/135678, later on published as granted U.S. Pat. No. 8,130,596 B2, discloses an electronic circuit for controlling the operation of a watch comprising a processor for interacting with peripheral members of the watch. The circuit has initializing means to allow controllers to provide inputs and outputs of and for peripheral members of the watch. One method according to this prior art allows to switch the processor from a passive mode to an active mode, whereby the active mode allows the processor to execute instructions. The processor receives an interruption signal from at least one peripheral member of the watch, wherein said signal is transmitted to the processor via the connecting means; the processor is switched on, he executes the instruction associated with the interruption signal and places the processor again in the passive mode once the instruction has been executed or into a standby mode to reduce the overall electrical power consumption of the electronic watch circuit. One mandatory peripheral member is the system used to perform the function of a watch, either driving hands or providing a digital representation of the time.

US 2013/0303087 A1 discloses a connected device platform where different communication elements are combined. It is mentioned that this includes smart watches, connected music players, smartphones, tablet computers, and eBook readers, providing especially wireless access to different media. The document states that smart watches are reducing the power consumed by an additional radio link and would be enabled to use coin-cell batteries. These watches typically have rich interfaces and display text on the watch face. Users of these devices frequently complain that they cannot read the text on account of its small size, that the digital display is not very elegant, and that they prefer an analog watch. FIG. 3 of this prior art combines traditional analog hands and a digital display behind the analog movement.

U.S. Pat. No. 5,289,452 provides initialization means acting on the peripheral members of a watch without intervention of the processor onto the initializing means.

EP 2 541 347 A2 discloses an electronic timekeeping circuit with two power supply domains. Power is supplied to each of the power supply domains by a corresponding one of the power supplies. Timekeeping registers are duplicated for each of the power supply domains. The timekeeping registers are synchronized between the power supply domains if one of the timekeeping registers is modified or if one of the power supplies is turned off and subsequently turned back on. The timekeeping circuit uses a single piece of silicon for the system. The registers are duplicated to save power. However, each time the microprocessor wakes up, it synchronizes and sets the registers, wherein this action takes additional power. Furthermore the document is related to a RTC. A real time clock does not have motors or motor drivers and is not a chip able to drive a watch movement.

U.S. Pat. No. 5,045,988 describes an isolated adjustable frequency AC inverter control, including a low voltage microcontroller referenced to ground potential and a waveform generator coupled to the microcontroller through a serial data link including optical isolation devices. The waveform generator floats at the negative bus potential of the DC source for the inverter. The waveform generator produces switching signals for the inverter under control of the microcomputer. The waveform generator, serial communications circuitry and other support circuits are all part of a single application specific integrated circuit.

U.S. Pat. No. 6,047,380 relates to a microcontroller wake-up function for a microprocessor using an. $I^2C$ circuitry and interrupt as the microcontroller receives it, whereas the present invention which are usually not used in a watch chip.

SUMMARY OF THE INVENTION

Based on this prior art it is an object of the invention to provide an improved electronic watch circuit for controlling the operation of a watch having analogue hands or other means of display allowing for less battery power consumption during normal watch operation while being flexible in providing support for a variety of peripheral functions. Whilst the circuit described here controls analogue hands, it could also be made to control another form of time display based on LED, LCD or electronic ink.

An electronic watch circuit for controlling the operation of a watch having analogue hands according to an embodiment of the invention comprises a first integrated circuit (ASIC), including control functions realized in control logic connected to a non-volatile memory, which contains data values to be transmitted to registers, where said data values define required timing and functional parameters, a quartz crystal providing the clock base frequency to the ASIC and connecting means arranged for enabling the registers, the non-volatile memory and the logic to communicate data values relating to the operation of said watch and drivers to drive the watch hands or other low power watch functions such as alarm.

The electronic circuit comprises a first integrated circuit including control functions realized in control logic connected to a non-volatile memory comprising OTP memory, which contains data values to be transmitted to registers, peripheral members and peripheral member drivers connected to said peripheral members, wherein the peripheral member drivers are configured to interact with the peripheral members of the watch, a quartz crystal providing the clock base frequency to the first integrated circuit, and connecting means arranged for enabling the peripheral member drivers, the quartz crystal, the non-volatile memory and the control logic to communicate data relating to the operation of said watch to each other; wherein the electronic watch circuit further comprises a microcontroller as second integrated circuit being provided separate from the first integrated circuit including a microprocessor connected to a programmable memory, wherein the first electronic circuit as well as the microcontroller comprise readable and writable registers, wherein said first integrated circuit comprises an interface, said microcontroller comprises a further interface and the microcontroller is connected with the first integrated circuit by said interfaces allowing bidirectional exchange of data to be read and written from and into said registers between the microcontroller and the first integrated circuit.

The solution according to the present invention avoids using a processor or CPU or microcontroller but has a non-CPU solution that is autonomous. An advantage resides inter alia in the fact that any additional microcontroller can be used with it and nevertheless the usual watch function is capable to be achieved at lowest power consumption.

The interfaces can be serial interfaces, especially $I^2C$ or SPI interfaces. They also can be parallel interfaces. The advantage of an $I^2C$ interface is the simple connection with reduced space requirements by SCL and SDA connections.

The non-volatile memory of the first integrated circuit can consist of OTP (one time programmable) memory. The logic additional has said rewritable registers in the framework of the interface.

The first electronic circuit as well as the microcontroller comprises readable and writable registers for the respective interfaces, especially for transmitting data and/or time information. This information can especially be used for setting data and/or time in the first electronic circuit on instructions from the microcontroller and/or vice versa, i.e. be used for setting data and/or time in the microcontroller on instructions from the first electronic circuit. The information may also comprise data for alarm and/or other functions.

The interfaces of the microcontroller and the first electronic circuit can be connected to further peripheral members for further smart watch related functionalities, temperature, GPS localization, GSM or bluetooth related functionalities.

Furthermore, the electronic watch circuit can include condition control means able to act on the microcontroller directly, especially as a user associated push-button or a sensor output to the microcontroller. Such a sensor can provide an output signal based on a battery related signal as charging status, a light input related signal as based on illumination of the dial or a temperature related input signal via a threshold. This signal of the sensor is a trigger signal. Such a trigger signal then influences the condition control means to act on the microcontroller.

Additional condition control means can also comprise instructions transmitted from the first integrated circuit via the interfaces to the microcontroller. Then the control means are provided as inter alia wake-up instructions within the first integrated circuit.

The signals issued by the condition control means are adapted to put the microcontroller in a sleep-mode or to wake-up the microcontroller.

The invention also comprises an integrated circuit including control functions realized in control logic connected to a non-volatile memory which contains data values to be transmitted to registers and to be transmitted to peripheral member drivers to interact with peripheral members of a watch using the above described electronic watch circuit.

US 2009/135678 uses an electronic watch circuit with initializing means able to act on the peripheral member controllers to initialize said controllers by sending data without actions of the processor and enable said controllers to carry out operations independently of the processor and/or the non-volatile memory. It is not explained what the CPU of the prior art controls; in the present invention a separate chip is used and the initialization is done using OTP in the chip. In another embodiment said separate chip can also be initialized from a separate microcontroller, e.g. a microcontroller in a Bluetooth RF chip.

EP 2 541 347 A2 provides duplicated registers. The ASIC according to the present invention has single registers that are always on. Nevertheless the power consumption is lower since the ASIC is in most functions a known watch chip with the addition that access to said registers is granted.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF THE INVENTION

Figure 1:
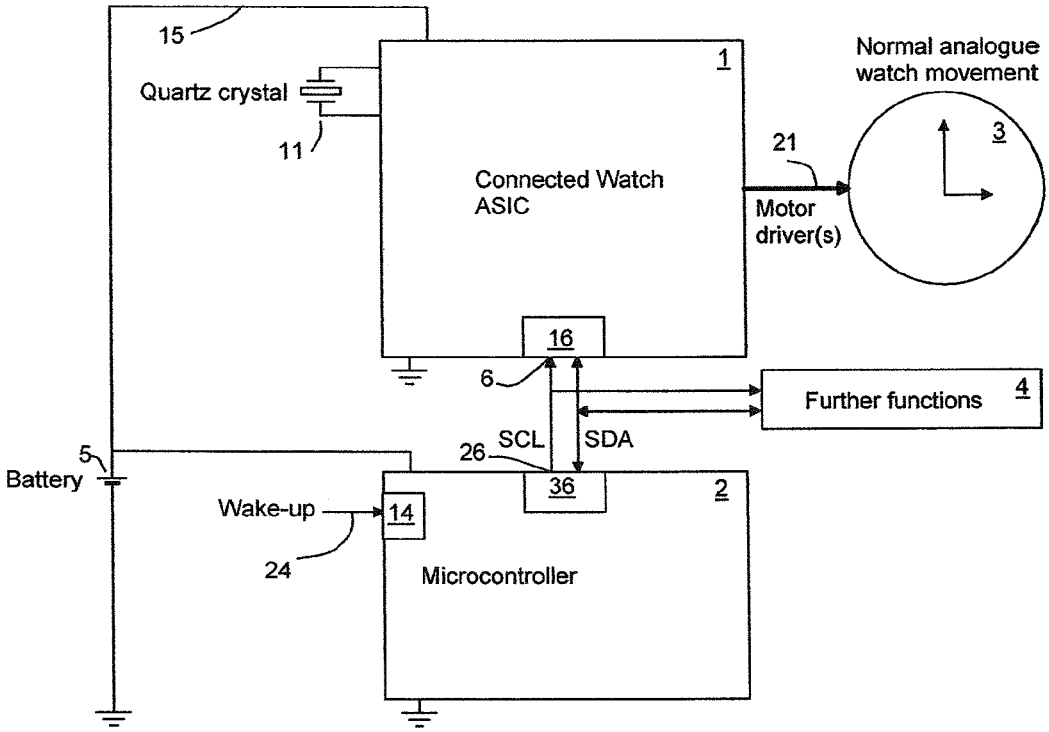
FIG. 1 illustrates a connected watch ASIC system according to an embodiment of the invention.

FIG. 1 illustrates a connected watch ASIC system according to an embodiment of the invention. The connected watch ASIC 1 drives a standard analogue watch movement 3. The functional capability of the analogue movement may include but is not limited to display of sub-seconds such as tenths of seconds, seconds, minutes, hours, tides, moon phase and alarm. A typical watch ASIC contains an oscillator connected to an external quartz crystal 11 for the generation of a 32,768 Hz clock and internal circuitry to provide precisely timed drive currents on connection 21 to the watch movement motors based on frequencies generated within the watch ASIC by the said circuitry.

The connected watch ASIC 1 has, in addition, an interface 6 that allows its registers 16 to be read and written by an external device such as a microcontroller 2. The interface 6 may also be connected to other devices 4 enabling further functionality.

The interface 6 illustrated is an I2C serial interface that is well known in the industry. Other interfaces such as SPI (which is another serial interface) or a parallel interface could also be used but a serial interface has the advantage of fewer connections and this is important to keep the watch module area small.

As usual SDA relates to the Serial Data Line and SCL to the Serial Clock Line. The usual 7 or 10 bit address space with transmittal rates of 100 kbit/s or 400 kbit/s are sufficient for the transmittal of time and data related information.

A further interface 26 is provided on the side of the microcontroller, which must be the same as that on the ASIC.

Depending on the type of interface 6 used within the ASIC 1, other interfaces 26 such as SPI or a parallel interface could also be used in combination with the ASIC's interface 6. Then the interface 26 of the microcontroller 2 allows its registers 36 to be read and written by the ASIC 1. The interface 26 may also be connected to other devices 4 enabling further functionality.

The system is preferably powered by a 1.5V coin type of battery 5. The battery anode 5 connects with supply lines 15 and 25 the connected watch ASIC 1 as well as the microcontroller 2.

The microcontroller 2 is a general purpose programmable device usually containing a processor core, memory and programmable input/output peripherals. The microcontroller 2 has a wake-up unit 14, and is capable of being woken up, either by the user with an external button or sensor 24, or by the connected watch ASIC 1 via the serial interface 6. Then there is a connection between the interface 26 and the wake-up unit 14. The microcontroller 2 can also shut itself down or be shut down by the user with the or a further external button or sensor 24, or it can be shut down by the connected watch ASIC 1 via the serial interface 6. After such a shut-down, the microcontroller 2 is in a sleep-mode and consumes minimum power.

Figure 2:
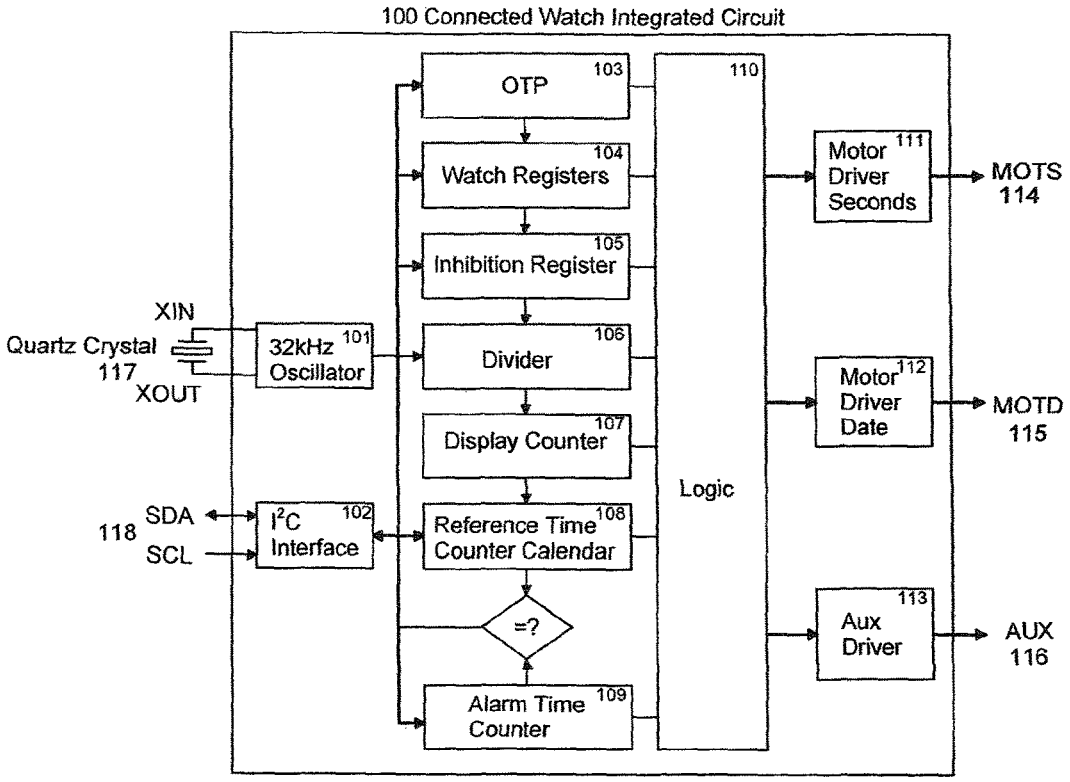
FIG. 2 shows a connected watch integral circuit according to an embodiment of the invention.

The connected watch ASIC 1 illustrated in FIG. 2 is comprised of the ASIC 100, serial interface 118, in this case an $I^2C$ interface 102 but it could also be an SPI or other integrated circuit interface, a 32,768 Hz quartz crystal 117, motors 114 for seconds and 115 for date, and an auxiliary output 116 to drive functions other than a motor (a piezo-electric buzzer for an alarm for example).

The ASIC 100 is comprised of a 32,768 Hz oscillator 101, an $I^2C$ interface 102, a non-volatile one time programmable (OTP) memory 103, registers for various watch parameters 104, an inhibition register 105 for adjusting time accuracy, a divider chain 106 for division of the 32,768 Hz quartz frequency to several suitable frequencies for operation as a watch, a display counter 107 containing the value of time displayed, a reference time counter calendar 108 containing the actual value of time in seconds, minutes, hours, days, months and years, including information about leap years, an alarm counter 109 to store a value of time for an alarm, a logic block 110 to control all logical operation, motor driving circuitry 111 for the seconds hand, motor driving circuitry 112 for the date, and auxiliary driving circuitry 113 to drive an output for other functions. The non-volatile memory can comprise or consist of one time programmable (OTP) memory.

The motors drivers 111, 112 in FIG. 1 are shown as an illustration. Additional motor drivers can be added or substituted if required. For example additional motor drivers can be added to drive additional motors for a chronograph. The connected watch concept allows parameters of the motor like motor pulse width, duty cycle and period to be set either using the OTP or via the watch registers 104 by communication from a controller via the $I^2C$ interface 118.

As shown in FIG. 2, the connected watch integrated circuit may also have other outputs 116 that add to the functionality such as an alarm driver or a vibrator driver.

The $I^2C$ interface 102 allows the watch registers 104 and counters to be read and written by an external controller. The watch alarm time counter 109 is able to trigger an interrupt on the $I^2C$ line that can be used to wake up the controller 2 of FIG. 1 which in turn may wake up other components such as an RF-link (e.g. Bluetooth) or sensors (e.g. vibration sensor) to enable different smart functions, possibly also addressed on the $I^2C$ interface 26 of the microcontroller 2.

Figure 3:
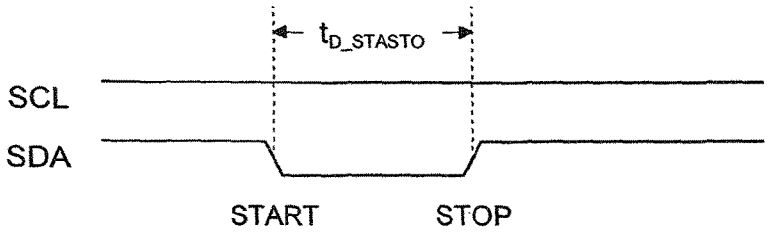
FIG. 3 a signal diagram against time for the serial interface according to an embodiment of the invention.

FIG. 3 shows a diagram of the interrupt signal against time for the serial interface according to an embodiment of the invention. In order to flag an interrupt over the $I^2C$ bus, the connected watch ASIC 100 behaves like an $I^2C$ master with restricted functionality. The interrupt is signaled by sending a START condition 201, immediately followed by a STOP condition 202 after a time $t_{D\text{-}STASTO}$. This is illustrated in FIG. 3. It is possible, but not mandatory that no further $I^2C$ master capabilities are supported. But it is possible to restrict the $I^2C$ master capabilities to the ones mentioned.

The watch movement contains the integrated circuit 1 or 100, a quartz crystal 11 or 117 and all necessary mechanical features for the realization of a quartz watch. Using the connected watch ASIC 1 as outlined above allows a controller 2 to read an exact time from a watch movement 3 or 114 or 115 via the associated register content of the ASIC or set an exact time in the watch movement. The connected watch ASIC 1 as outlined above allows a controller 2 to set an alarm in a watch movement that can later be used to wake up the said controller 2. In other words, the active microcontroller 2 calculates the set time for its next action on peripheral members, and transmits this time as wake-up signal via the serial bus to the ASIC 1 which accepts this time and is programmed to use this signal to wake up the microcontroller 2 in due course. Meanwhile, the microcontroller 2 shuts down automatically or—more secure—the acceptance of the time as wake-up signal by the ASIC 1 is used to send the shut-down signal back over the serial bus to the microcontroller 2. An example of such a function could be making contact with a GSM base station or GPS unit for determination of position.

Since it is usual that a controller 2 uses far more power than the "watch components" of a watch (for example a controller 2 will consume perhaps several micro-amps and a connected watch ASIC 1 with drivers will consume perhaps less than a hundred nano-amps), power from the battery 5 can be saved by switching off the controller 2 when it is not required. The controller 2 can be switched on or off by means of the button over line 24 or by the interrupt from the connected watch ASIC 1 via the serial interfaces 6 and 26. The watch movement may operate continuously at a rate of power consumption comparable with a normal quartz watch.

This has the following advantages:

1) Makers of a "smart watch" or "smart wearable" retain watch functionality when the "smart" function is disabled.
2) Power consumption of a "smart watch" or "smart wearable" can be reduced by switching off the "smart" function when not required.
3) Standard watch movements have been developed over many years to allow attractive and fashionable design. The "smart" functionality can be integrated into a design that is already considered fashionable.
4) Standard watch movements are waterproof to a specified depth of water.
5) The connected watch movement is able to power-on the "smart" function by means of an interrupt allowing the "smart" function effectively to wake itself up at a predetermined time. Alternatively the user can switch the controller on using a button when required.
6) Smart functions can be displayed or signaled using the connected watch. Examples could be: Counting steps, Counting hours slept, Compass, Vibration "silent" alarm for incoming calls, Automatic time zone adjustment, Barometer as well as Temperature.
7) The system is not limited to a particular microcontroller 2. The user is free to choose the type of controller that he wishes, since the ASIC 1 is a separate chip.
8) The connected watch ASIC 1 has the advantage that it can either be configured using the non-volatile memory as a standalone watch ASIC or it can be configured as and when required using a controller. This gives the manufacturer flexibility and cuts down on the number of ASICs he must have in his inventory.
9) The described connected watch ASIC also has the advantage of being able to drive the date such that at the start/end of the month, the correct number of days is displayed because the month and year information is available. This can be implemented using a separate motor for the date display for example.

| LIST OF REFERENCE SIGNS | |
|---|---|
| 1 | connected watch ASIC |
| 2 | microcontroller |
| 3 | analogue watch movement |
| 4 | further function unit |
| 5 | battery |
| 6 | $I^2C$ interface |
| 11 | quartz crystal |
| 14 | wake-up unit |
| 15 | supply line |
| 16 | registers |
| 21 | watch movement connection |
| 24 | wake-up line |
| 25 | supply line |
| 26 | $I^2C$ interface |
| 36 | registers |
| 100 | connected watch ASIC |
| 101 | 32 kHz oscillator |
| 102 | I2C interface |
| 103 | OTP |
| 104 | watch register |
| 105 | inhibition register |
| 106 | divider |
| 107 | display counter |
| 108 | reference time counter |
| 109 | alarm time counter |
| 110 | logic block |
| 111 | motor driver seconds |
| 112 | motor driver date |
| 113 | motor driver auxiliary systems |
| 114 | motor seconds |
| 115 | motor date |
| 116 | auxiliary motors |
| 201 | start signal time |
| 202 | stop signal time |

The invention claimed is:

1. An electronic watch circuit for controlling the operation of a watch movement, comprising a first integrated circuit including control functions realized in control logic connected to a non-volatile memory comprising OTP memory, which contains data values to be transmitted to registers, peripheral members and peripheral member drivers connected to said peripheral members, wherein the peripheral member drivers are configured to interact with the peripheral members of the watch, a quartz crystal providing a clock base frequency to the first integrated circuit, and connecting means arranged for enabling the peripheral member drivers, the quartz crystal, the non-volatile memory, and the control logic to communicate data relating to the operation of said watch to each other, wherein the electronic watch circuit further comprises a microcontroller as a second integrated circuit being provided separate from the first integrated circuit including a microprocessor connected to a programmable memory, wherein the first integrated circuit as well as the microcontroller comprise readable and writable registers, wherein said first integrated circuit comprises a first interface, said microcontroller comprises a second interface and the microcontroller is connected with the first integrated circuit by said first and second interfaces allowing bidirectional exchange of data to be read and written from and into said registers between the microcontroller and the first integrated circuit.

2. The electronic watch circuit according to claim 1, wherein the first and second interfaces are serial interfaces.

3. The electronic watch circuit according to claim 1, wherein the non-volatile memory of the first integrated circuit consists of OTP memory.

4. The electronic watch circuit according to claim 1, wherein the readable and writable registers for the first and second interfaces are provided for transmitting data and/or time information.

5. The electronic watch circuit according to claim 1, wherein the interfaces are connected to further peripheral members for further smart watch related functionalities.

6. The electronic watch circuit according to claim 1, wherein the electronic watch circuit further includes condition control means able to act on the microcontroller directly, as a user associated push-button or a sensor output, wherein the sensor can provide optionally a physical translated signal such as a battery related, a light input related, or a temperature related trigger signal.

7. The electronic watch circuit according to claim 1, wherein the electronic watch circuit further includes condition control means able to act on the microcontroller as instructions transmitted from the first integrated circuit via the first and second interfaces to the microcontroller.

8. The electronic watch circuit according to claim 7, wherein the signals of the condition control means are configured to put the microcontroller in a sleep-mode or to wake-up the microcontroller.

9. An integrated circuit for an electronic watch circuit of a watch, including control functions realized in control logic connected to a non-volatile memory comprising OTP memory, further comprising a first interface and readable and writable registers, which non-volatile memory contains data values to be transmitted to said registers and to be transmitted to peripheral member drivers of peripheral members of the watch as well as provided for allowing a bidirectional exchange of data to be read and written from and into said registers through said first interface and an associated second interface of a separate microcontroller of the watch.

10. The integrated circuit according to claim 9, wherein the first and second interfaces are serial interfaces.

11. The integrated circuit according to claim 9, wherein the non-volatile memory of the first integrated circuit consists of OTP memory.

12. The electronic watch circuit according to claim 2, wherein the serial interfaces are $I^2C$ interfaces.

13. The electronic watch circuit according to claim 4, wherein the readable and writable registers for the first and second interfaces are provided for setting or reading data and/or time in the first integrated circuit on instructions from the microcontroller.

14. The integrated circuit according to claim 10, wherein the serial interfaces are $I^2C$ interfaces.

* * * * *